US010602277B2

(12) United States Patent
Xiao

(10) Patent No.: US 10,602,277 B2
(45) Date of Patent: Mar. 24, 2020

(54) ACOUSTIC DEVICE

(71) Applicant: AAC Technologies Pte. Ltd., Singapore (SG)

(72) Inventor: Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,509

(22) Filed: Dec. 27, 2018

(65) Prior Publication Data

US 2019/0230442 A1 Jul. 25, 2019

(30) Foreign Application Priority Data

Jan. 24, 2018 (CN) ..... 2018 1 0070163

(51) Int. Cl.

| | |
|---|---|
| ***H04R 9/02*** | (2006.01) |
| ***H04R 9/04*** | (2006.01) |
| ***H04R 1/02*** | (2006.01) |
| ***H04R 7/02*** | (2006.01) |
| ***H04R 9/06*** | (2006.01) |
| *H04R 7/04* | (2006.01) |

(52) U.S. Cl.

CPC ..... *H04R 9/025* (2013.01); *H04R 1/02* (2013.01); *H04R 7/02* (2013.01); *H04R 9/043* (2013.01); *H04R 9/046* (2013.01); *H04R 9/06* (2013.01); *H04R 7/04* (2013.01); *H04R 2209/024* (2013.01); *H04R 2400/11* (2013.01); *H04R 2499/11* (2013.01)

(58) Field of Classification Search

CPC ..... H04R 9/025; H04R 9/043; H04R 9/06; H04R 7/02; H04R 1/02; H04R 9/046; H04R 7/04; H04R 2400/11; H04R 2499/11; H04R 2209/024; H04R 9/02

See application file for complete search history.

(56) References Cited

U.S. PATENT DOCUMENTS

| | | | | | |
|---|---|---|---|---|---|
| 3,112,374 | A * | 11/1963 | Gorike | H04R 11/00 | 381/417 |
| 4,804,911 | A * | 2/1989 | Saito | G01P 1/026 | 324/167 |
| 7,978,872 | B2 * | 7/2011 | Dam | B06B 1/04 | 381/340 |
| 2002/0071590 | A1 * | 6/2002 | Han | H04R 9/025 | 381/412 |
| 2004/0218779 | A1 * | 11/2004 | Fukuyama | H04R 1/06 | 381/409 |

(Continued)

*Primary Examiner* — Oyesola C Ojo

(74) *Attorney, Agent, or Firm* — IPro, PLLC; Na Xu

(57) ABSTRACT

The present disclosure provides an acoustic device, including a frame, a vibration system fixed to the frame, a magnetic circuit system configured to drive the vibration system to vibrate and produce a sound, and a magnetic frame sealing cap configured to fix the magnetic circuit system to the frame, where the magnetic circuit system includes a magnetic yoke and a magnet fixed to the magnetic yoke, the magnetic frame sealing cap includes a bottom wall and a side wall that is in a ring shape and is bent and extends from a periphery of the bottom wall, the magnetic yoke is fixed to the bottom wall, and the side wall is fixed to the frame. Compared with the related art, the acoustic performance of the acoustic device of the present disclosure is optimal.

9 Claims, 3 Drawing Sheets

(56) References Cited

U.S. PATENT DOCUMENTS

| | | | | |
|---|---|---|---|---|
| 2005/0018869 | A1* | 1/2005 | Ajiki | H04R 9/066 381/394 |
| 2011/0243371 | A1* | 10/2011 | Xu | H04R 1/06 381/433 |
| 2011/0293121 | A1* | 12/2011 | Yan | H04R 7/04 381/191 |
| 2011/0311093 | A1* | 12/2011 | He | H04R 9/06 381/410 |
| 2017/0134864 | A1* | 5/2017 | Shi | H04R 9/025 |

* cited by examiner

ACOUSTIC DEVICE

CROSS-REFERENCE TO RELATED APPLICATIONS

This application claims the priority benefit of Chinese Patent Applications Ser. No. 201810070163.5 filed on Jan. 24, 2018, the entire content of which is incorporated herein by reference.

TECHNICAL FIELD

The present disclosure relates to the acoustoelectric field, and in particular, to an acoustic device used in a portable electronic product.

BACKGROUND

With the advent of the era of mobile internet, a quantity of smart mobile apparatuses is continuously increasing. Among multiple mobile apparatuses, a mobile phone is undoubtedly a most common and portable mobile terminal apparatus. Acoustic devices such as speakers and receivers for playing sounds are now widely used in smart mobile apparatuses such as mobile phones.

A vibration system and a magnetic circuit system used in an acoustic device directly determine a sound quality of the acoustic device. To enhance a stability of the vibration system, a vibration system of an acoustic device of the related art includes: a first vibrating diaphragm fixed to a frame, a voice coil configured to drive the first vibrating diaphragm to vibrate and produce a sound, and a second vibrating diaphragm configured to enhance a transverse stability of the voice coil. The magnetic circuit system includes a magnetic yoke, a magnet fixed to the magnetic yoke, and a flange that is bent and extends from a periphery of the magnetic yoke. The magnetic circuit system directly contacts and is fixed to the frame through alignment features such as the flanges.

However, in the acoustic devices of the related art, for a single magnetic circuit and superlinear acoustic device, for example, a single magnetic circuit and superlinear receiver, the magnetic circuit system cannot directly contact the frame to form a fixation due to block and restriction by the structures of the second vibrating diaphragm and the flange. As a result, development of the acoustic performance of such type of acoustic device is restricted.

Therefore, it is indeed desired to provide a novel acoustic device to resolve the foregoing technical problem.

BRIEF DESCRIPTION OF THE DRAWINGS

To illustrate the technical schemes in the embodiments of the present disclosure, the following briefly describes the accompanying drawings required for describing the embodiments. Apparently, the accompanying drawings in the following description merely show some embodiments of the present disclosure, and persons of ordinary skill in the art can derive other drawings from these accompanying drawings without creative efforts.

DETAILED DESCRIPTION

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person skilled in the art based on the embodiments of the present disclosure without creative efforts shall fall within the protection scope of the present disclosure.

Figure 1:
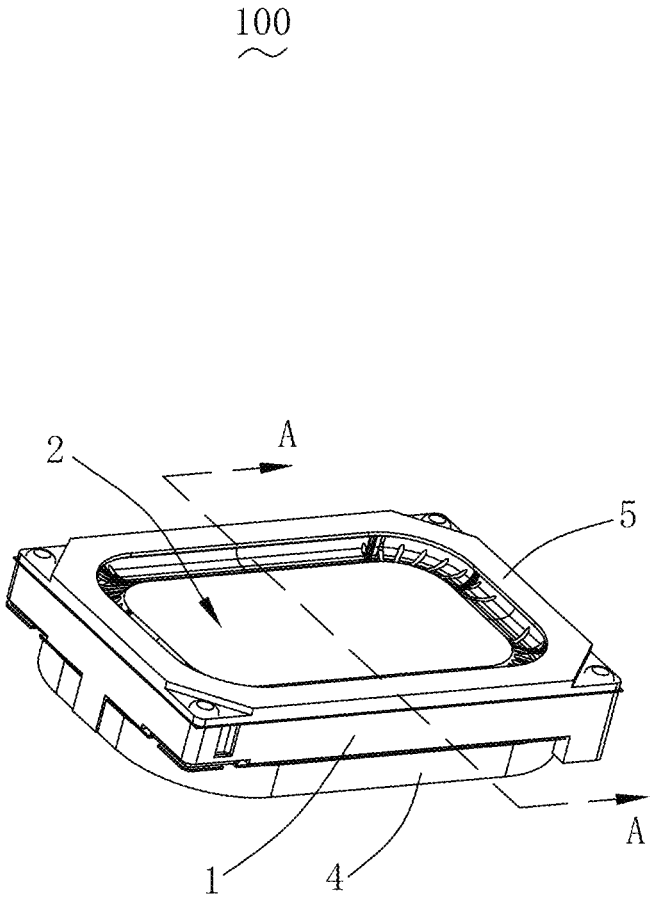
FIG. 1 is a three-dimensional schematic structural diagram of an acoustic device of the present disclosure.
Figure 2:
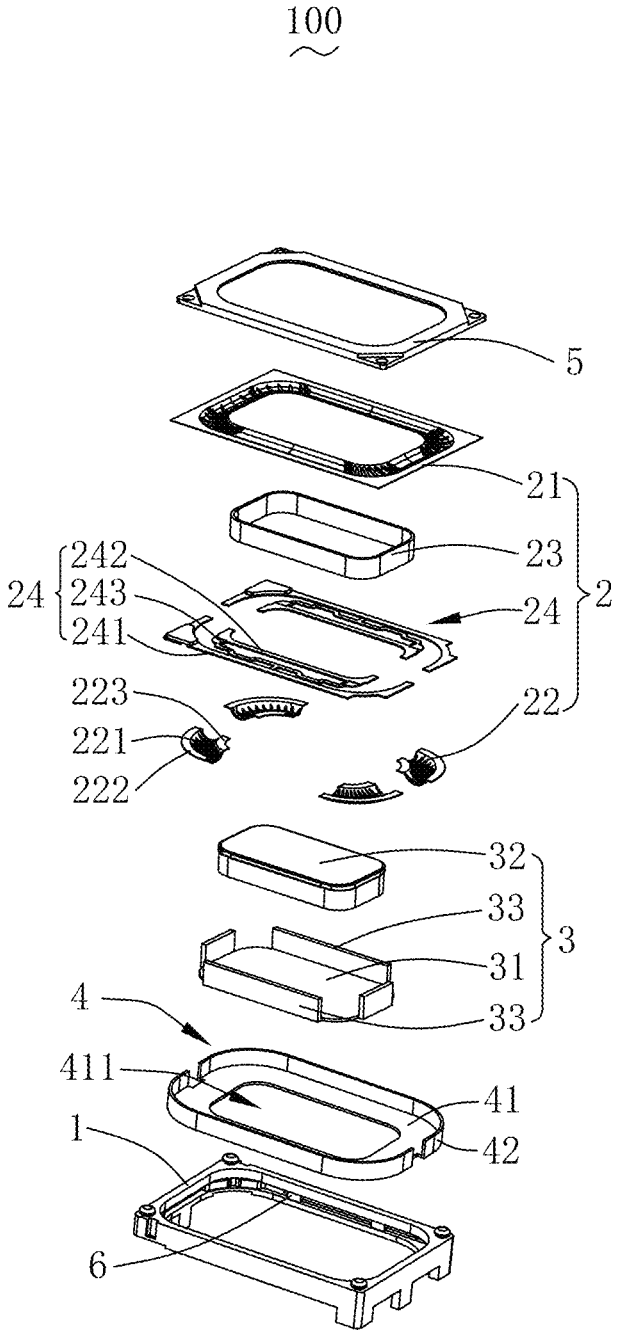
FIG. 2 is a three-dimensional exploded view of a part of an acoustic device of the present disclosure.
Figure 3:
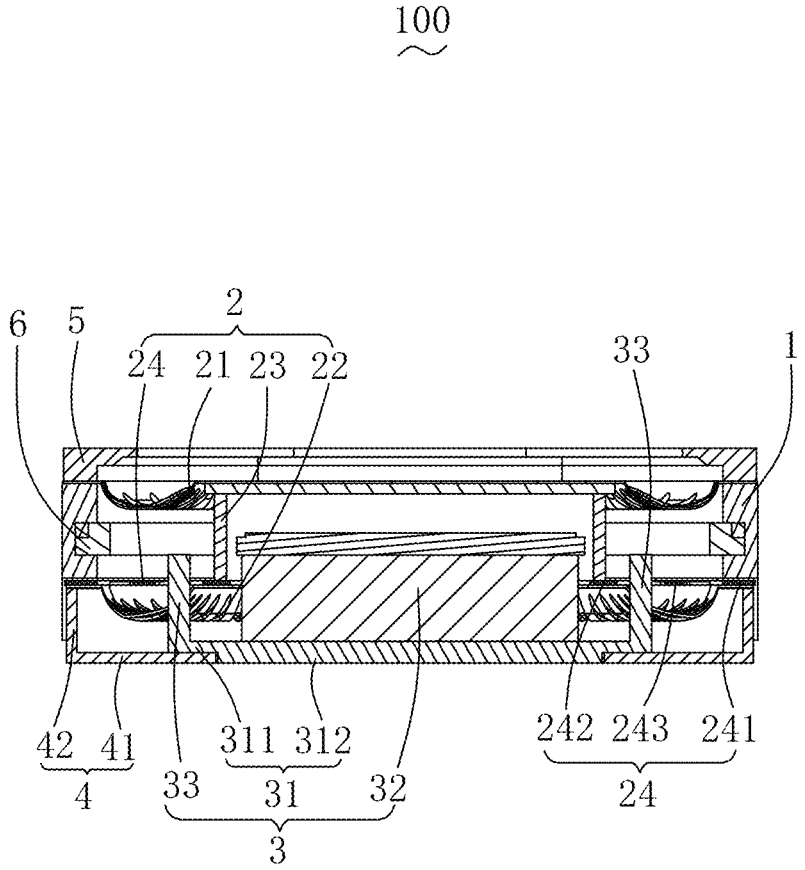
FIG. 3 is a cross-sectional view along line A-A in FIG. 1.

Referring to FIG. 1 to FIG. 3, the present disclosure provides an acoustic device 100, including a frame 1, a vibration system 2, a magnetic circuit system 3 configured to drive the vibration system 2 to vibrate, a magnetic frame sealing cap 4, and a front cover 5 covering the frame 1.

The frame 1 is configured to fix and support the vibration system 2 and the magnetic circuit system 3. The frame 1 may be in a round shape, a rectangular shape, or the like. The frame, for example, in a rectangular shape is used in this implementation for description.

To reduce a volume of the frame 1, a reinforcing rib 6, for example, made of a stainless steel, in a ring shape may be embedded in the frame, by which not only the strength of the frame 1 can be enhanced, thereby improving the reliability, but also the volume of the frame 1 is enabled to become smaller, thereby saving space and optimizing the magnetic circuit system 3.

The vibration system 2 includes a first vibrating diaphragm 21 and a second vibrating diaphragm 22 respectively fixed to the frame 1, a voice coil 23 configured to drive the first vibrating diaphragm 21 to vibrate and produce a sound, and an FPC 24 (Flexible Printed Circuit) configured to support and fix the second vibrating diaphragm 22.

The first vibrating diaphragm 21 is configured to vibrate and produce a sound. The voice coil 23 is fixed to the first vibrating diaphragm 21, thereby forming a suspension.

The second vibrating diaphragm 22 is fixed to an end of the voice coil 23 away from the first vibrating diaphragm 21. In this implementation, to further enhance the vibration stability and reliability of the acoustic device 100, four second vibrating diaphragms 22 are arranged at intervals. Certainly, a quantity of the second vibrating diaphragms 22 is not limited herein. The four second vibrating diaphragms 22 are arranged symmetrically and in sections in structure. On one hand, the space is saved, and on the other hand, an anti-swing performance of the voice coil 23 is strengthened and the acoustic performance and reliability of the acoustic device 100 are improved.

Specifically, the second vibrating diaphragm 22 includes a vibration portion 221, a first fixing portion 222, and a second fixing portion 223. The first fixing portion 222 and the second fixing portion 223 extend from two opposite sides of the vibration portion 221 and are fixed to the frame 1 and the voice coil 23, respectively.

The voice coil 23 is electrically connected to the FPC 24.

The FPC 24 supports and fixes the second vibrating diaphragm 22. In this implementation, every two of the second vibrating diaphragms 22 are fixed to two opposite ends of a same FPC 24.

More preferably, the two FPCs 24 are arranged in parallel to a long axis of the frame 1, respectively, and the four second vibrating diaphragms 22 are located at four corners of the frame 1, respectively.

Specifically, the FPC 24 includes a first fixing arm 241 and a second fixing arm 242 arranged at an interval and an elastic arm 243 configured to connect the first fixing arm 241 and the second fixing arm 242. The first fixing arm 241 is fixed to the frame 1. The second fixing arm 242 is fixed to an end of the voice coil 23 away from the first vibrating diaphragm 21. More preferably, the voice coil 23 is electrically connected to the second fixing arm 242.

In this implementation, the first fixing arm 241 is arranged in parallel to the second fixing arm 242. The elastic arm 243 is arranged substantially parallel to the first fixing arm 241 or the second fixing arm 242, and at an interval with the first fixing arm 241 or the second fixing arm 242, to form a gap.

The first fixing portion 222 of the second vibrating diaphragm 22 is fixed to the first fixing arm 241, the second fixing portion 223 is fixed to the second fixing arm 242, and the vibration portion 221 and the elastic arm 243 are arranged at an interval. That is, the second vibrating diaphragm 22 is fixed to the frame 1 through the FPC 24 and forms a support for the voice coil 23.

In the foregoing structure, on one hand, a voice coil lead wire structure is replaced with the FPC 24 and the voice coil 23 is directly connected to an external power supply, so that the problem of low reliability of the acoustic device 100 caused by beak risks of the voice coil lead wire is avoided; and on the other hand, the second vibrating diaphragm 22 prevents vibration and swing of the voice coil 23 and strengthens the vibration performance of the vibration system 2, so that the acoustic performance of the acoustic device 100, such as the acoustic strength, becomes optimal and the stability becomes better.

In this implementation, specifically, two FPCs 24 are arranged at an interval, and the two FPCs 24 are disposed around the magnetic circuit system 3.

The magnetic circuit system 3 includes a magnetic yoke 31, a magnet 32 fixed to the magnetic yoke 31, and flanges 33 that are bent and extend from a periphery of the magnetic yoke 31 toward the second vibrating diaphragm 22.

The flanges 33 are disposed around the magnet 32 at intervals, to form magnetic intervals. The flanges 33 are inserted in a gap between the voice coil 23 and the elastic arm 243.

In this implementation, there are two pairs of flanges 33, namely, four flanges. Two of the flanges are disposed corresponding to the two FPCs 24.

The arrangement of the flanges 33 forms a block for the magnetic induction lines generated by the magnet 32, to effectively prevent leakage of the magnetic induction lines, thereby improving the magnetic performance of the magnetic circuit system 3 and optimizing the acoustic performance of the acoustic device 100. Meanwhile, the two flanges 33 are inserted between the elastic arm 243 of the FPC 24 and the voice coil 23, so that the anti-swing effect on the voice coil 23 by the FPC 24 and the second vibrating diaphragm 22 is not affected.

The magnetic frame sealing cap 4 is made of stainless steel, specifically made of a SUS430 stainless steel. The magnetic frame sealing cap 4 includes a bottom wall 41 and a side wall 42 that is in a ring shape and is bent and extends from a periphery of the bottom wall 41.

The magnetic yoke 31 is fixed to the bottom wall 41. In this implementation, the magnetic yoke 31 is fixed to the bottom wall 41 by laser spot welding.

The bottom wall 41 is provided with a through hole 411 running through the bottom wall 41 and the magnetic yoke 31 covers and is fixed to the through hole 411.

More preferably, the magnetic yoke 31 includes a main body portion 311 and a protrusion portion 312 that protrudes and extends toward the bottom wall 41 from an end of the main body portion 311 away from the magnet 32, the main body portion 311 abuts against the bottom wall 41, and the protrusion portion 312 is caught in the through hole 411. By the structure, the efficiency of assembling the magnetic yoke 31 and the magnetic frame sealing cap 4 is high and the fixing strength is great.

The side wall 42 is fixed to the frame 1, so as to fix the magnetic circuit system 3 to the frame 1 through the magnetic frame sealing cap 4.

The stainless steel material of the magnetic frame sealing cap 4 helps reduce rear cavity leakage of the acoustic device 100 and leakage of the magnetic induction lines, to optimize the acoustic performance of the acoustic device 100, and meanwhile plays a role in connecting the frame 1 and the magnetic circuit system 3.

When the acoustic device 100 is applied to electronic equipment such as a mobile phone, influences of the acoustic device 100 on other devices such as a camera, especially a focusing means, are extremely reduced due to the blocking effect of the SUS430 material and structure of the magnetic frame sealing cap 4 on the magnetic induction lines of the magnetic circuit system.

The front cover 5 and the first vibrating diaphragm 21 are disposed opposite to each other to form a sound passage, configured to produce a sound.

Compared with the related art, the magnetic circuit system of the acoustic device of the present disclosure is of a single magnetic circuit and superlinear structure, and cannot be directly fixed to the frame due to restrictions of other structures, and by additionally disposing the magnetic frame sealing cap, arranging the magnetic circuit system to be fixed to the bottom wall of the magnetic frame sealing cap and arranging the side wall of the magnetic frame sealing cap to be fixed to the frame, the magnetic circuit system is fixed and supported on the frame. In addition, the magnetic frame sealing cap helps reduce rear cavity leakage of the acoustic device and leakage of the magnetic induction lines, to optimize the acoustic performance of the acoustic device, and reduces influences on other devices due to the blocking effect on the magnetic induction lines of the magnetic circuit system.

The above descriptions are only implementation manners of the present disclosure, and it should be noted that persons of ordinary skill in the art may further make improvements therefor without departing from the inventive concept of the present disclosure. However, these improvements fall within the protection scope of the present disclosure.

What is claimed is:

1. An acoustic device, comprising a frame, a vibration system fixed to the frame, and a magnetic circuit system configured to drive the vibration system to vibrate and produce a sound, wherein the magnetic circuit system comprises a magnetic yoke and a magnet fixed to the magnetic yoke, and the acoustic device further comprises a magnetic frame sealing cap configured to fix the magnetic circuit system to the frame, wherein the magnetic frame sealing cap comprises a bottom wall and a side wall that is in a ring shape and is bent and extends from a periphery of the bottom wall, the magnetic yoke is fixed to the bottom wall, and the side wall is fixed to the frame;

the vibration system comprising a first vibrating diaphragm respectively fixed to the frame, a voice coil configured to drive the first vibrating diaphragm to vibrate and produce a sound, and an FPC configured to support and fix the voice coil, wherein the FPC comprises a first fixing arm and a second fixing arm arranged at an interval and an elastic arm configured to connect the first fixing arm and the second fixing arm, the first fixing arm is fixed to the frame, and the second fixing arm is fixed to an end of the voice coil away from the first vibrating diaphragm.

2. The acoustic device according to claim 1, wherein the bottom wall is provided with a through hole running through the bottom wall and the magnetic yoke covers and is fixed to the through hole.

3. The acoustic device according to claim 2, wherein the magnetic yoke comprises a main body portion and a protrusion portion that protrudes and extends toward the bottom wall from an end of the main body portion away from the magnet, the main body portion abuts against the bottom wall, and the protrusion portion is caught in the through hole.

4. The acoustic device according to claim 1, wherein the magnetic frame sealing cap is made of stainless steel.

5. The acoustic device according to claim 4, wherein the magnetic frame sealing cap is made of a SUS430 stainless steel.

6. The acoustic device according to claim 1, wherein the magnetic yoke is fixed to the bottom wall by laser spot welding.

7. The acoustic device according to claim 1, wherein the magnetic circuit system further comprises flanges that are bent and extend from a periphery of the magnetic yoke and the flanges are disposed around the magnet at intervals.

8. The acoustic device according to claim 1, wherein there are two pairs of flanges of the magnetic yoke, wherein one pair of the flanges is inserted in a gap between the voice coil and the elastic arm.

9. The acoustic device according to claim 1, wherein the vibration system further comprises a second vibrating diaphragm elastically supporting the voice coil.

* * * * *